US006969434B1

(12) United States Patent
Chan et al.

(10) Patent No.: US 6,969,434 B1
(45) Date of Patent: Nov. 29, 2005

(54) CASTABLE THERMOBARIC EXPLOSIVE FORMULATIONS

(75) Inventors: May Lee Chan, Ridgecrest, CA (US); Dung Tri Bui, Ridgecrest, CA (US); Gary Meyers, Ridgecrest, CA (US); Alan Turner, Ridgecrest, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/326,958

(22) Filed: Dec. 23, 2002

(51) Int. Cl.[7] ..... C06B 45/10
(52) U.S. Cl. ..... 149/19.5
(58) Field of Search ..... 149/19.5

(56) References Cited

U.S. PATENT DOCUMENTS 3,839,106 A * 10/1974 De Prisque et al. ..... 149/19.9
3,865,035 A * 2/1975 Munson et al. ..... 102/364
3,886,007 A * 5/1975 Combs et al. ..... 149/19.2
4,163,681 A * 8/1979 Rothenstein et al. ..... 149/19.4
4,283,237 A * 8/1981 Reed et al. ..... 149/19.91
H1341 H * 8/1994 Hughes et al. ..... 149/19.4
5,411,615 A * 5/1995 Sumrail et al. ..... 149/47
5,750,921 A 5/1998 Chan et al.
5,996,501 A * 12/1999 Spencer et al. ..... 102/286
6,238,499 B1 * 5/2001 Jones et al. ..... 149/19.4
6,615,737 B2 * 9/2003 Bonnel et al. ..... 102/481
6,652,682 B1 * 11/2003 Fawls et al. ..... 149/22

* cited by examiner

*Primary Examiner*—John R. Hardee
(74) *Attorney, Agent, or Firm*—Anthony J Serventi; Laura R Foster; Charlene A Haley

(57) ABSTRACT

The invention disclosed herein relates to an explosive capable of enhanced combustion efficiently capable of sustaining a high pressure over a period of time in a confined environment, such as an air tight room or a cave, where oxygen may be in limited supply. An embodiment of the present invention is a metal composite that combines a binder, a reactive metal and an oxidizer. In another embodiment, a plasticizer and a catalyst may be added. In a preferred embodiment of the present invention, a solid fuel-air explosive (SFAE) having an annular design is used. In a typical annular design, a cylindrical shell of SFAE surrounds the cylindrically shaped high explosive. The SFAE may be selected from the group consisting of reactive metal and metal composite. In addition, the metal composite is formed from at least one reactive metal, at least one binder and an oxidizer.

5 Claims, 1 Drawing Sheet

CASTABLE THERMOBARIC EXPLOSIVE FORMULATIONS

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

BACKGROUND OF THE INVENTION

1. Field of the Invention

The invention disclosed herein relates to explosive formulations with improved combustion efficiency. More particularly, the explosive formulations of the invention are capable of maintaining a relatively high blast pressure in an oxygen poor environment, such as a tunnel or other confined spaces.

2. Description of the Related Art

There is a long history of studying blast explosives, reactive metals and associated metal combustion technologies. The success of the development of Solid Fuel-Air-Explosive (SFAE) has been demonstrated providing 30–40% increased internal blast over a conventional explosive. SFAE is a singular event with combined mixing and initiation of the reaction. In confined spaces, transition to full detonation is not required for enhanced blast, if the solid fuel is ignited early in the dispersion process. A series of reflective shock waves generated by the detonation mixes the hot detonation gases with metal particles and compresses the metal particles at the same time. These actions provide the chemical kinetic support to maintain a hot environment, causing more metal to ignite and burn. This late time metal combustion process produces a significant pressure rise over a longer time duration (10–50 msec). This is a phase generally referred to as after burning or late-time impulse which can occur outside of where the detonation occurred, resulting in more widespread damage.

Aluminum has been used as the metal of choice, due to high heat of combustion, cost and availability. Billets of SFAE made with Al, provide savings in volume with increased fuel mass for blast performance. However, combustion efficiency has been an issue, especially in the event that the fuel content (35–60 wt %) is high with respect to the total weight of explosive composition. Poor combustion efficiency is often observed in many of the thermobaric warhead tests, which causes the severe ineffectiveness of the weapon. This is due to the high ignition temperature, 2200 K, typically required for proper combustion of AL. During the burning of Al, heat is produced and aluminum oxide is formed. However, the burning of all the metal to completion requires maintaining the hot environment. This environment can be best maintained if it is supported chemically by the combustion of other oxidizer species (i.e. AP or nitrate ester liquid, IPN (isopropyl nitrate)) that are much easier to ignite (AP has an ignition temperature of 250 C and IPN has a low flash point of 22 C). The combustion of these additives produce the hot gases to support the burning of metal, thus 100% combustion efficiency can be obtained. Metal composites, metal and oxidizer combined granules, produced from coating of particles with a binder, can be made easily with techniques well known in the art.

Another combined approach to further improve the metal combustion efficiency is to use a more reactive metal as part of or as the entire metal fuel component. New reactive metal materials such as nano-sized aluminum to increase the reactivity, titanium and boron alloy to increase the thermal output, and magnesium/aluminum alloy to lower the ignition temperature are among the most promising approaches to increase the metal combustion efficiency. More powerful explosives such as CL-20 that are capable of raising the detonation pressure and temperature are also extremely beneficial.

There exists a need in the art for new explosive formulations with new reactive metal and metal composites to have 50–100% higher blast energy than those by the baseline composition such as Tritonal or PBX N109. Further, the new formulations coupled with new warhead designs will have the potential to form one of the most powerful thermobaric warheads, when compared to the weapon systems that currently exist.

SUMMARY OF THE INVENTION

A preferred embodiment of the present invention is a metal composite that combines a binder, a reactive metal and an oxidizer. In a more preferred embodiment of the present invention, a plasticizer and a catalyst may be added. In another preferred embodiment of the present invention, the binder is selected from those polymers capable of coating the reactive metal and oxidizer powder. Two of the preferred methods to produce the compositions of the current invention are:

(1) The coated powder forms the fuel charge through pressing, combining this fuel charge with a high explosive charge (HMX, RDX or CL-20 based PBX's) in an annular design to make up the fill for the warhead.

(2) Using metal or metal/oxidizer powders in a mixing, casting and curing process to combine with high explosive to form castable PBX's. The reactive metal contains ingredients that are intrinsically reactive with the reaction products of high explosive and oxidizer with or without the presence of high concentration of oxygen.

A preferred embodiment of the present invention discloses a metal composite comprising about 60.0 to about 96.0 weight % of at least one reactive metal, about 4.0 to about 10.0 weight % of at least one binder and about 0.0 to about 36.0 weight % of an oxidizer. The reactive metal may be selected from the group consisting of nano-sized metal particles, metastable mechanical alloy and any combination thereof. More specifically, the reactive metal may be selected from the group consisting of nano-sized aluminum, nano-sized boron and nano-sized titanium, nano-sized magnesium, Al—Mg, Al—Mg—H, B—Mg, Al—B and Ti—B. The binder may be selected from the group consisting of copolymer of vinylidine fluoride hexafluoropropylene, nitrocellulose, GAP and Zeon.

A preferred embodiment of the present invention relating to castable compositions discloses an explosive having an annular design. The explosive comprises a cylindrical shell of solid fuel air explosive surrounding a cylindrically shaped high explosive. The solid fuel air explosive may be selected from the group consisting of reactive metal and metal composite. The metal composite comprises about 60.0 to about 80.0 weight % of at least one reactive metal, about 4.0 to about 8.0 weight % of at least one binder and about 0.0 to about 36.0 weight % of an oxidizer. The reactive metal may be selected from the group consisting of nano-sized metal particles, metastable mechanical alloy and any combination thereof. More specifically, the reactive metal may be selected from the group consisting of nano-sized aluminum, nano-sized boron and nano-sized titanium, nano-sized magnesium, Al—Mg, Al—Mg—H, B—Mg, Al—B and Ti—B, H-2 (2 μm spherical aluminum) and H-5 (5 μm spherical aluminum). The oxidizer may be selected from the group consisting of ammonium perchlorate, ammonium dinitramide and ammonium nitrate.

One object of a preferred embodiment the present invention is to provide an explosive with enhanced combustion efficiently capable of sustaining a high pressure over a period of time in a confined environment with a limited oxygen supply.

Another object of a preferred embodiment the present invention is to provide an explosive capable of maintaining a relatively high pressure (30–60 psi) for up to 50 msec in an environment characterized with high rate of thermal quenching (cold air), this environment has a profound adverse effect for metal combustion, which is the main cause for combustion efficiency.

Another object of a preferred embodiment the present invention is to provide an explosive with increased reactivity, increased thermal output and lower ignition temperatures.

Another object of a preferred embodiment the present invention is to provide thermobaric explosive formulations with reactive metals and metal composites which have a 100% higher blast energy than compositions such as Tritonal and PBX N109.

These and other objects of the invention will become more clear when one reads the following specification, taken together with the drawings that are attached hereto. The scope of protection sought by the inventors may be gleaned from a fair reading of the claims that conclude this specification.

DETAILED DESCRIPTION OF THE INVENTION

Figure 1:
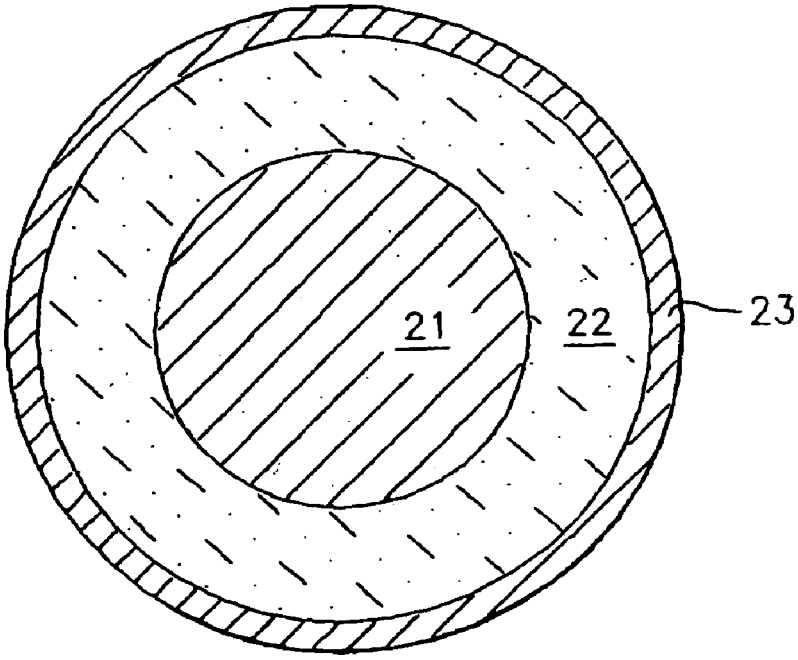
FIG. 1 is a sectional view of a typical explosive having an annular design.

The invention disclosed herein relates to an explosive capable of enhanced combustion efficiently capable of sustaining a high pressure over a period of time in a confined environment, such as an air tight room or a cave, where oxygen may be in limited supply.

The reactive metal used in a preferred embodiment of the present invention includes nano-sized metal particles, metastable mechanical alloys and any combination thereof. The metal fuel in these explosive formulations of the present invention may incorporate nano-sized aluminum, such as Alex®, boron, manganese and titanium, those having a size of about 20–500 nm. The metastable mechanical alloys include Al—Mg, Al—Mg—H, B—Mg, Al—B, Ti—B, H-2 and H-5 made from high energy milling. The metastable mechanical alloys are nano-crystalline metastable phases with particle sizes of about 1–50 μm. The reactive metal used may also include Ti, B or Mg. In a preferred embodiment of the present invention, the reactive metal comprises about 60.0–80.0 weight % of the total metal composite, preferably at about 74.0 weight %.

The thermobaric explosive formulations of a preferred embodiment of the present invention incorporate high energy explosive material such as hexa-nitro-hexa-aza-isowurtzitane (CL-20), cyclotrimethylenetrinitramine (RDX) and cyclotetramethylene tetranitramine (HMX). The powerful oxidizers, such as ammonium perchlorate (AP), ammonium dinitramide (ADN), ammonium nitrate (AN) and barium nitrate are selected to be used in the metal composite or castable PBX's. A preferred embodiment of the present invention uses ammonium perchlorate (AP) particles, preferably about 11–100 μm in size. The oxidizer comprises about 12.0–36.0 weight % of the total metal composites, preferably at about 20.0 weight %.

The binder is selected from those polymers capable of coating the reactive metal and high explosive powder. Preferably the binder is selected from the group consisting of copolymer of vinylidine fluoride hexafluoropropylene, such as Viton®, nitrocellulose, glycidyl azide polymer (GAP) or an acrylic acid ester polymer, such as Zeon®. In a preferred embodiment of the present invention, the binder comprises about 4.0–6.0 weight % of the total metal composites, preferably at about 4.0 weight % for the total metal composite. The binders used for castable PBX's may be hydroxy-terminated polybutadienes (HTPB), hydroxy-terminated polycaprolactone (PCP), hydroxy-terminated polyesters, hydroxy-terminated polyethers (HTPE), Glycidyl azide polymer (GAP), trifluoroethyl-terminated poly (1-cyano-1-difluoramino)-polyethylene glycol (PCDE) and any combination thereof. Typically, 5.0 to 7.0 weight % is used for castable PBX version.

In a more preferred embodiment, a plasticizer and a burn rate catalyst may be added. The preferred plasticizer is bis-(2,2-ro-2-fluoroethyl) formal (FEFO). However, other plasticizers may be utilized, including energetic plasticizers selected from those compounds, which are liquids and contain energetic moieties or groups in their chemical structures. These moieties can include nitro or nitrate ester groups, azido groups, or nitramino groups. Suitable plasticizers include TEGDN (triethyleneglycol dinitrate), or Butyl NENA (n-butyl-2-nitratoethyl-nitramine). Other suitable plasticizers include DEGDN (diethyleneglycol dinitrate), TMETN (trimethylolethane trinitrate), and BTTN (butanetriol trinitrate). These plasticizers may be used independently or in combination. Other fluoramino groups such as bis-(2,2-ro-2-fluoroethyl) formal (FEFO) and bis-[2,2-bis (difluoramino)-5,5-dinitro-5-fluoropentoxy] methane (SYFO) may be incorporated into the formulations. In a preferred embodiment of the present invention, the plasticizer comprises about 4.0 weight % of the formulations.

Iron oxide (Fe2O3), nano-sized is a suitable burn rate catalyst and is preferable to exotic burn rate catalysts such as superfine iron oxide, chromic oxide, catocene, or carboranes. Aluminum oxide may also be used. In a preferred embodiment of the present invention, the burn rate catalyst comprises about 1.0 weight % of the total metal composites. Tables I and II disclose a number of the preferred formulations of the present invention.

TABLE I

Chemical Composition of Metal Composite Coated by Various Binders

| Reactive Metal | Oxidizer | Binder | Plasticizer | Catalyst |
|---|---|---|---|---|
| 80% H-5 | 14% AP, 11 μm | 6% Viton ® | None | None |
| 60% H-5, 20% Al/Mg alloy, 28 μm | 14% AP, 11 μm | 6% Viton ® | None | None |
| 80% H-5 | 12% AP, 11 μm | 6% Viton ® | None | 1% $Fe_2O_3$, nano-sized |
| 74% H-5 | 20% AP, 11 μm | 6% Viton ® | None | 1% $Fe_2O_3$, nano-sized |
| 37% Ti, 44 μm 37% B, 0.6–7 μm | 21% AP, 11 μm | 6% Nitrocellulose | None | None |

TABLE I-continued

Chemical Composition of Metal Composite Coated by Various Binders

| Reactive Metal | Oxidizer | Binder | Plasticizer | Catalyst |
|---|---|---|---|---|
| 74% Ti—B, 20 μm | 21% AP, 11 μm | 6% Nitrocellulose | None | None |
| 74% Mg—B, 20 μm | 21% AP, 11 μm | 6% Nitrocellulose | None | None |
| 50% H-5 24% Alex ®, 0.2 μm | 20% AP, 11 μm | 5% Nitrocellulose | None | 1% $Fe_2O_3$, nano-sized |
| 50% H-5 24% Alex ®, 0.2 μm | 20% AP, 11 μm | 4% Nitrocellulose | 4% FEFO | 1% $Fe_2O_3$, nano-sized |
| 74% Alex ®, 0.2 μm | 20% AP, 11 μm | 5% Nitrocellulose | None | 1% $Fe_2O_3$, nano-sized |
| 40% Flake Al, 20% Al/Mg alloy | 36% AP, 100 μm | 4% Viton ® | None | None |

Note: Al/Mg milled in batch MA020129-01, Ti—B milled in batch MA020317-01, and Mg—B milled in batch MA020319-01 at New Jersey Institute of Technology, Newark, New Jersey.

TABLE II

Typical Composition of Castable PBX's Containing Reactive Metal and AP Oxidizer

| | Oxidizer | Binder | High Explosive | Plasticizer & Catalyst |
|---|---|---|---|---|
| Reactive Metal | | | | |
| 20–40% | 15–35% AP, 11–100 μm | 10–15% HTPB | 30–55% HMX | 4–6% |
| Metal Composite | | | | |
| 40–60% | None | 10–15% HTPB | 30–45% HMX or 30–50% HMX | None |
| 40–60% | None | 10–15% LMA | 30–45% HMX | None |
| 30–55% | None | 10–15% HTPB | 35–60% CL-20 | None |
| 20–24% | 15–35% AP | 10–15% HTPB | 30–55% HMX | None |

Note: metal composite contains oxidizer

The novel thermobaric explosives of the present invention are spherical particles of composite material containing high explosive, oxidizer, reactive metal and binder. Plasticizer and burn rate catalyst may be added to manipulate performance. A method of making the novel thermobaric explosives described herein is disclosed in U.S. Pat. No. 5,750,921 issued to Chan et al. on May 12, 1998, hereby incorporated herein by reference.

In a preferred embodiment of the present invention, a solid fuel-air explosive annular design is used as shown in FIG. 1. In a typical annular design, a cylindrical shell of solid fuel air explosive (SFAE) 22 surrounds the high explosive 21. As a matter of preference, the shapes of the high explosive charge are preferably spherically or cylindrically symmetric, to provide a uniform dispersion pattern. Solid metal casings 23 are typically pressed from reactive metal powder or metal composite (listed in Table 1) as SFAE. These solid metal casings are typically machined from stock into billets, but can also be manufactured by other methods such as casting or forging. The SFAE is then pressed into solid billets with a density (preferred to be 80–90% TMD) applicable to the particular use. The annular design preferably uses flake aluminum as the reactive metal. The SFAE billets are then placed in the warhead and the explosive is cast or pressed into place. The final SFAE fuel to explosive ratio is dependent upon the size and configuration of the warhead. PBX N112 consists of 89% HMX (high explosive) and 11% LMA (lauryl methacrylate). The PBX N112/reactive metal weight ratio is preferably in the range 0.66 to 1.45, most preferably the ratio is 1.0.

In another preferred embodiment, the compositions of the present invention are formed into a unicharge. The unicharge design preferably uses spherical aluminum as the reactive metal. Table II discloses preferred ranges of ingredients for the formulations of the unicharge embodiment. As noted previously, a plasticizer and/or a burn rate catalyst may be added to the formulations to tailor the formulations to particular needs. Although specific binders are listed, any of the binders previously noted may be used in the formulations. Similarly, any of the oxidizers previously noted may be substituted for AP and any of the high explosives previously noted may be substituted for HMX.

Although the description above contains many specificities, these should not be construed as limiting the scope of the invention but as merely providing an illustration of the presently preferred embodiment of the invention. Thus the scope of this invention should be determined by the appended claims and their legal equivalents.

What is claimed is:

1. An explosive charge composition comprising:

a metal composite including oxidizer, reactive metal and binder said metal composite comprising;

about 15.0 to about 35.0 weight % of ammonium perchlorate oxidizer;

about 30.0 to about 40.0 weight % of said reactive metal comprising aluminum having a particle size of about 0.08 μm to about 5 μm;

about 10.0 to about 15.0 weight % of said binder, wherein said binder includes lauryl methacrylate (LMA); and about 30.0 to about 55.0 weight % of high explosive.

2. The explosive charge composition of claim 1, wherein said high explosive is about 30.0 to about 45.0 weight %.

3. The explosive charge composition of claim 1, wherein said high explosive is selected from the group consisting of hexa-nitro-hexa-aza-isowurtzitane (CL-20), cyclotrimethylenetrinitramine (RDX) and cyclotetramethylene tetranitramine (HMX).

4. The explosive charge composition of claim 1, further comprising a binder selected from the group consisting of hydroxy-terminated polybutadienes (HTPB), hydroxy-terminated polycaprolactone (PCP), hydroxy-terminated polyesters or hydroxy-terminated polyethers (HTPE), glycidyl azide polymer (GAP), and trifluoroethyl-terminated poly (1-cyano-1-difluoramino)-polyethylene glycol (PCDE).

5. The explosive charge composition of claim 1, wherein said high explosive is cyclotetramethylene tetranitramine (HMX), and said metal composite is about 55 to 60.0 weight %.

* * * * *